US005879419A

United States Patent [19]

Moriyama et al.

[11] Patent Number: 5,879,419

[45] Date of Patent: Mar. 9, 1999

[54] METHOD FOR PRODUCING SUPERHEAVY OIL EMULSION FUEL

[75] Inventors: Noboru Moriyama, Wakayama; Akio Hiraki; Toshimitsu Ichinose, both of Nagasaki; Koichi Sakamoto, Tokyo, all of Japan

[73] Assignees: Kao Corporation; Mitsubishi Jukogyo Kabushiki Kaisha, both of Tokyo, Japan

[21] Appl. No.: 973,311

[22] PCT Filed: May 27, 1996

[86] PCT No.: PCT/JP96/01431

§ 371 Date: Dec. 1, 1997

§ 102(e) Date: Dec. 1, 1997

[87] PCT Pub. No.: WO96/38519

PCT Pub. Date: Dec. 5, 1996

[30] Foreign Application Priority Data

Jun. 1, 1995 [JP] Japan ..... 7-159948

[51] Int. Cl.[6] ..... C10L 1/32

[52] U.S. Cl. ..... 44/301

[58] Field of Search ..... 44/301

[56] References Cited

U.S. PATENT DOCUMENTS

| | | | |
|---|---|---|---|
| 5,024,676 | 6/1991 | Moriyama et al. | 44/301 |
| 5,399,293 | 3/1995 | Nunez et al. | 252/314 |
| 5,411,558 | 5/1995 | Taniguchi et al. | 44/301 |
| 5,505,876 | 4/1996 | Rivas et al. | 44/301 |
| 5,551,956 | 9/1996 | Moriyama et al. | 44/301 |

FOREIGN PATENT DOCUMENTS

| | | |
|---|---|---|
| 1185394A | 2/1988 | Japan . |
| 1313595A | 12/1989 | Japan . |

OTHER PUBLICATIONS

*Kirk–Othmer Encyclopedia of Chemical Technology,* 3rd Ed., vol. 8, pp. 910–916 (1979).

*Primary Examiner*—Jacqueline V. Howard
*Attorney, Agent, or Firm*—Birch, Stewart, Kolasch & Birch, LLP

[57] ABSTRACT

The method for producing a superheavy oil emulsion fuel includes the steps of (a) adding to a superheavy oil 0.1 to 0.6 parts by weight of a nonionic surfactant having an HLB (hydrophilic-lipophilic balance) of 13 to 19, based on 100 parts by weight of the superheavy oil, and water, to prepare a homogeneous liquid mixture; and (b) mechanically mixing the homogeneous liquid mixture with a high shearing stress, to produce a superheavy oil emulsion fuel having a particle size distribution. In this method, a 10% cumulative particle size is from 1.5 to 8 μm, a 50% cumulative particle size is from 11 to 30 μm, and a 90% cumulative particle size is from 25 to 150 μm, and coarse particles having particle sizes of 150 μm or more occupy 3% by weight or less in the entire emulsion fuel, and the concentration of the superheavy oil is from 76.5 to 82.0% by weight.

8 Claims, 2 Drawing Sheets

METHOD FOR PRODUCING SUPERHEAVY OIL EMULSION FUEL

This application claims the benefit under 35 U.S.C. §371 of prior PCT International Application No. PCT/JP96/01431 which has an International filing date of May 27, 1997 which designated the United States of America, the entire contents of which are hereby incorporated by references.

TECHNICAL FIELD

The present invention relates to a method for producing an oil-in-water type, superheavy oil emulsion fuel which is usable as fuels for thermoelectric power generation.

BACKGROUND ART

It is well known that the superheavy oil emulsion fuels give stable emulsion fuels when used together with additives, such as emulsifiers, stabilizers, and fluidizing agents, and various excellent emulsifiers to be used in emulsion fuel compositions have been developed (See Japanese Patent Laid-Open No. 1-185394, U.S. Pat. No. 5,024,676, and Japanese Patent Laid-Open No. 1-313595). However, even when these additives including emulsifiers, stabilizers, and fluidizing agents are used, the concentration of the superheavy oil in the superheavy oil emulsion fuel is at most 77% by weight. A superheavy oil emulsion fuel which is stable and has good fluidity is easy to handle. As the concentration of the superheavy oil increases, the thermal energy loss by water decreases, thereby making the resulting emulsion fuel more valuable. Also, a high superheavy oil concentration is beneficial because it can be diluted upon use where necessary.

DISCLOSURE OF THE INVENTION

In view of the above problems, an object of the present invention is to provide a method for producing a stable, easy-to-handle superheavy oil emulsion fuel having a highly concentrated superheavy oil having good fluidity.

Another object of the present invention is to provide a superheavy oil emulsion fuel obtainable by the above method.

Conventionally, it has been common to one skilled in the art that the particle size distribution must be widened in order to produce highly concentrated emulsion fuels.

As a result of intensive research in view of solving the above problems, the present inventors have found that a stable emulsion can be obtained at a superheavy oil concentration exceeding 77% by weight by limiting an amount of the superheavy oil in the emulsion to a particular range, limiting the kinds and amounts of the surfactants and an agitation stress to particular ranges, and limiting the particle size distribution to a given range. The present invention has been completed based upon these findings.

Specifically, the present invention is concerned with the following:

(1) A method for producing a superheavy oil emulsion fuel comprising the steps of:

(a) adding to a superheavy oil 0.1 to 0.6 parts by weight of a nonionic surfactant having an HLB (hydrophilic-lipophilic balance) of 13 to 19, based on 100 parts by weight of the superheavy oil, and water, to prepare a homogeneous liquid mixture; and (b) mechanically mixing the homogeneous liquid mixture with a high shearing stress, to produce a superheavy oil emulsion fuel having a particle size distribution wherein a 10%-cumulative particle size is from 1.5 to 8 μm, a 50%-cumulative particle size is from 11 to 30 μm, and a 90%-cumulative particle size is from 25 to 150 μm, and wherein coarse particles having particle sizes of 150 μm or more occupy 3% by weight or less in the entire emulsion fuel, and wherein the concentration of the superheavy oil is from 76.5 to 82.0% by weight;

(2) The method described in item (1) above, wherein an anionic surfactant or cationic surfactant is further added in an amount so as not to exceed the amount of the nonionic surfactant in step (a);

(3) The method described in item (1) or item (2) above, wherein a polymeric compound selected from the group consisting of naturally occurring polymers and synthetic polymers, or a water-swellable clay mineral is further added in an amount so as not to exceed the amount of the nonionic surfactant in step (a);

(4) The method described in any one of items (1) to (3) above, wherein one or more compounds selected from the group consisting of oxides of magnesium, calcium, and iron, hydroxides of magnesium, calcium, and iron, and salts of magnesium, calcium, and iron are further added in an amount of 0.01 to 0.5 parts by weight, based on 100 parts by weight of the superheavy oil in step (a);

(5) The method described in any one of items (1) to (4) above, wherein the mechanical mixing is carried out at a shearing stress of from 1,000 to 20,000 $s^{-1}$;

(6) The method described in any one of items (1) to (5) above, subsequent to step (b), further comprising the step of:

(c) diluting the resulting mixture obtained in step (b) with water or a surfactant aqueous solution having an HLB of 13 to 19, to thereby adjust the viscosity (100 $s^{-1}$, 25° C.) of the resulting mixture to 3000 cp or less;

(7) The method described in any one of items (1) to (6) above, wherein the concentration of the superheavy oil is from 78.0 to 81.0% by weight;

(8) The method described in any one of items (1) to (7), wherein said nonionic surfactant is an alkylene oxide adduct of an alkylphenol;

(9) The method described in item (2) above, wherein said anionic surfactant is one or more compounds selected from the group consisting of lignin sulfonates, formalin condensates of lignin sulfonic acid and naphthalene-sulfonic acid or salts thereof, and formalin condensates of naphthalenesulfonates; and

(10) A superheavy oil emulsion fuel obtainable by the method described in any one of items (1) to (9) above, wherein the superheavy oil emulsion fuel has a particle size distribution wherein a 10%-cumulative particle size is from 1.5 to 8 μm, a 50%-cumulative particle size is from 11 to 30 μm, and a 90%-cumulative particle size is from 25 to 150 μm, and wherein coarse particles having particle sizes of 150 μm or more occupy 3% by weight or less in the entire emulsion fuel, and wherein the concentration of the superheavy oil is from 76.5 to 82.0% by weight.

BEST MODE FOR CARRYING OUT THE INVENTION

Figure 1:
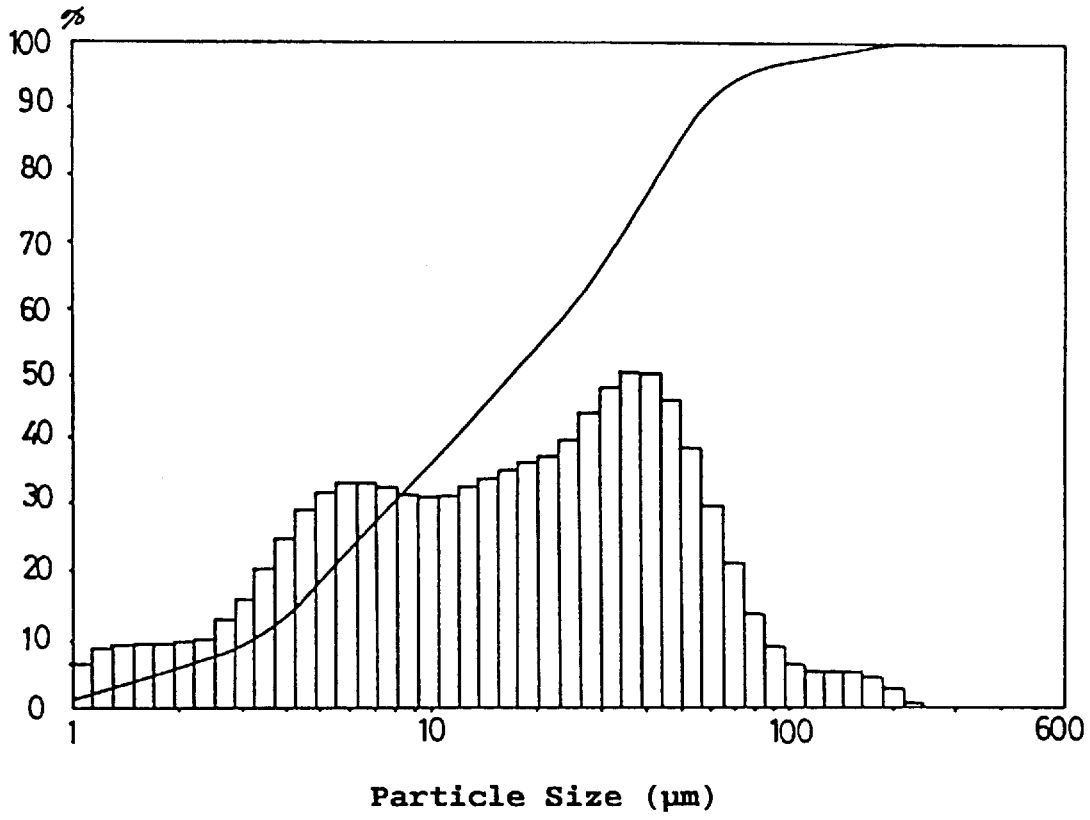
FIG. 1 is a graph showing a particle size distribution of an emulsion fuel obtained in Example 1.

The present invention will be explained in detail below.

The "superheavy oil" usable in the present invention refers to those in a solid or semi-fluid state at room temperature which do not flow unless heated to a high temperature. Examples of the superheavy oils include the following:

(1) Petroleum asphalts and mixtures thereof;

(2) Various treated products of petroleum asphalts, intermediates, residues, and mixtures thereof.

(3) High pour point-oils which do not even flow at high temperatures, or crude oils;

(4) Petroleum tar pitches and mixtures thereof; and (5) Bitumens (Orinoco tar and athabasca bitumen).

As for the surfactants usable in the present invention, a nonionic surfactant having an HLB of from 13 to 19 is suitably used. Further, an anionic surfactant or a cationic surfactant may be preferably added in an amount not exceeding that of the nonionic surfactant in order to give charges to the particles, and thereby generate repulsive forces between the particles. The "HLB" values in the present invention refer to an abbreviation of a hydrophilic-lipophilic balance calculated from the Griffin's equation. Specifically, the HLB is an index for surface activity by expressing intensity ratios between a hydrophilic property and a lipophilic property of a medium which shows both the hydrophilic and lipophilic properties. Here, the found values of Griffin et al. are employed (W. C. Griffin, "Kirk-Othmer Encyclopedia of Chemical Technology," 3rd ed., vol. 8, p.913–916, John-Wiley (1979)).

Examples of the nonionic surfactants usable in the present invention include the following ones:

(i) Alkylene oxide adducts of compounds having phenolic hydroxyl groups, such as phenol, m-cresol, butylphenol, nonylphenol, dinonylphenol, dodecylphenol, p-cumylphenol, and bisphenol A.

(ii) Alkylene oxide adducts of formalin (formaldehyde) condensates of compounds having phenolic hydroxyl groups, such as alkylphenols, phenol, m-cresol, styrenated phenol, and benzylated phenol, wherein the average degree of condensation is 1.2 to 100, preferably 2 to 20.

(iii) Alkylene oxide adducts of monohydric, aliphatic alcohols and/or monohydric, aliphatic amines each having 2 to 50 carbon atoms.

(iv) Block or random addition polymers of ethylene oxide/propylene oxide, ethylene oxide/butylene oxide, ethylene oxide/styrene oxide, ethylene oxide/propylene oxide/butylene oxide, and ethylene oxide/propylene oxide/styrene oxide.

(v) Alkylene oxide adducts of polyhydric alcohols, such as glycerol, trimethylolpropane, pentaerythritol, sorbitol, sucrose, polyglycerols, ethylene glycol, polyethylene glycols, propylene glycol, and polypropylene glycols, or esters formed between the above-described polyhydric alcohols and fatty acids having 8 to 18 carbon atoms.

(vi) Alkylene oxide adducts of polyvalent amines having a plurality of active hydrogen atoms, such as ethylenediamine, tetraethylenediamine, and polyethyleneimine (molecular weight: 600 to 10,000).

(vii) Products formed by addition reaction of alkylene oxides with a mixture comprising one mol of fats and oils comprising triglyceride and 0.1 to 5 mol of one or more polyhydric alcohols and/or water, the polyhydric alcohol being selected from the group consisting of glycerol, trimethylolpropane, pentaerythritol, sorbitol, sucrose, ethylene glycol, polyethylene glycols having a molecular weight of 1000 or less, propylene glycol, and polypropylene glycols having a molecular weight of 1000 or less.

In each of the nonionic surfactants (i) to (vii), the alkylene oxide means, for example, ethylene oxide, propylene oxide, butylene oxide, styrene oxide, and combinations thereof.

Among the above nonionic surfactants, a preference is given those listed in item (i), with a particular preference given to the alkylene oxide adducts of alkylphenols. The nonionic surfactants usable in the present invention have an HLB of normally from 13 to 19, preferably from 13.5 to 15.5. Although the nonionic surfactants having an HLB of less than 13 or exceeding 19 are also usable, those having HLB values in the range from 13 to 19 are preferable from the viewpoint of obtaining stable emulsion. In the present invention, the nonionic surfactants may be used alone or in combination of two or more kinds.

Examples of the anionic surfactants usable in the present invention include the following ones.

(i) Sulfonates of aromatic ring compounds, such as naphthalenesulfonates, alkylnaphthalenesulfonates, alkylphenolsulfonates, and alkylbenzenesulfonates, or formalin (formaldehyde) condensates of sulfonates of aromatic ring compounds, wherein the average degree of condensation of formalin is 1.2 to 100, and wherein the sulfonates are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts.

(ii) Lignin sulfonic acid, salts thereof, or derivatives thereof, formalin (formaldehyde) condensates of lignin sulfonic acid and sulfonic acids of aromatic compounds, such as naphthalenesulfonic acid and alkylnaphthalenesulfonic acids, and salts thereof, wherein the salts for both the lignin sulfonates and the sulfonates of aromatic compounds are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts, and wherein the average degree of condensation of formalin is from 1.2 to 50, preferably from 2 to 50. Among the lignins, excellent performance at high temperatures can be particularly achieved when a modified lignin, for instance, those substituted by one or more carbonyl groups, is used.

(iii) Polystyrenesulfonic acids or salts thereof, copolymers of styrenesulfonic acid with other copolymerizable monomer(s), or salts thereof, wherein the number-average molecular weight is from 500 to 500,000, preferably from 2,000 to 100,000, and wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Here, typical examples of the copolymerizable monomers include acrylic acid, methacrylic acid, vinyl acetate, acrylic acid ester, olefins, allyl alcohols and ethylene oxide adducts thereof, and acrylamide methylpropylsulfonic acid.

(iv) Polymers of dicyclopentadienesulfonic acid or salts thereof, wherein the number-average molecular weight of the polymers is from 500 to 500,000, preferably from 2,000 to 100,000, and wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts.

(v) Copolymers of maleic anhydride and/or itaconic anhydride with other copolymerizable monomer(s), or salts thereof, wherein the number-average molecular weight is from 500 to 500,000, preferably from 1,500 to 100,000, and wherein the salts are exemplified by ammonium salts; and alkali metal salts, such as sodium salts and potassium salts. Here, typical examples of the copolymerizable monomers include olefins, such as ethylene, propylene, butylene, pentene, hexene, heptene, octene, nonene, decene, undecene, dodecene, tridecene, tetradecene, pentadecene, and hexadecene, styrene, vinyl acetate, acrylic acid ester, acrylic acid, and methacrylic acid.

(vi) Maleinized liquid polybutadienes or salts thereof, wherein the number-average molecular weight of the liquid polybutadienes as the starting materials is from 500 to 200,000, preferably from 1,000 to 50,000, and wherein the degree of maleinization is at a level necessary for dissolving the polybutadiene in water, preferably from 40 to 70%, and wherein the salts are exemplified by ammonium salts, and alkali metal salts, such as sodium salts and potassium salts.

(vii) Anionic surfactants having in the molecule one or two hydrophilic groups, selected from the group consisting of the following (a) to (h):

(a) Sulfuric acid ester salts of alcohols having 4 to 18 carbon atoms, wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Typical examples thereof include sodium dodecyl sulfate and sodium octyl sulfate.

(b) Alkanesulfonic acids, alkenesulfonic acids, and/or alkylarylsulfonic acids, each having 4 to 18 carbon atoms, or salts thereof, wherein the salts are exemplified by ammonium salts; lower amine salts, such as monoethanolamine salts, diethanolamine salts, triethanolamine salts, and triethylamine salts; and alkali metal salts or alkaline earth metal salts, such as sodium salts, potassium salts, magnesium salts, and calcium salts. Typical examples thereof include sodium dodecylbenzene sulfonate, sodium butylnaphthalene sulfonate, and sodium dodecane sulfonate.

(c) Sulfates or phosphates of alkylene oxide adducts of compounds having in the molecule one or more active hydrogen atoms, or salts thereof, wherein the salts are exemplified by ammonium salts, or alkali metal salts or alkaline earth metal salts, such as sodium salts, potassium salts, magnesium salts, and calcium salts. Typical examples thereof include sulfuric acid ester sodium salts of polyoxyethylene(3 mol) nonyl phenyl ether, and phosphoric acid ester sodium salts of polyoxyethylene(3 mol) dodecyl ether.

(d) Sulfosuccinic acid ester salts of saturated or unsaturated fatty acids having 4 to 22 carbon atoms, wherein the salts are exemplified by ammonium salts, and alkali metal salts, such as sodium salts and potassium salts. Typical examples thereof include sodium dioctylsulfosuccinate, ammonium dioctylsulfosuccinate, and sodium dibutylsulfosuccinate.

(e) Alkyldiphenylether disulfonic acids or salts thereof, wherein the alkyl group has 8 to 18 carbon atoms, and wherein the salts are exemplified by ammonium salts, or alkali metal salts or alkaline earth metal salts, such as sodium salts, potassium salts, magnesium salts, and calcium salts.

(f) Rosins (or resin acids) or salts thereof, wherein the salts are exemplified by ammonium salts, and alkali metal salts, such as sodium salts and potassium salts. Examples thereof include mixed tall acids comprising a tall rosin and a higher fatty acid, and salts thereof.

(g) Alkanefatty acids or alkenefatty acids each having 4 to 18 carbon atoms, or salts thereof, wherein the salts are exemplified by ammonium salts, and alkali metal salts, such as sodium salts and potassium salts.

(h) α-Sulfofatty acid ester salts having an alkyl group of 4 to 22 carbon atoms and derivatives thereof, wherein the salts are exemplified by ammonium salts, or alkali metal salts or alkaline earth metal salts, such as sodium salts, potassium salts, and magnesium salts.

Among the anionic surfactants listed above, a preference is given to the lignin sulfonates, the formalin condensates of lignin sulfonic acid and naphthalenesulfonic acid or salts thereof, and the formalin condensates of naphthalenesulfonates because they show overall superior performance in charging the particles.

The cationic surfactants usable in the present invention are the following ones.

(i) Alkylamine salts and/or alkenylamine salts obtainable by neutralizing an alkylamine or alkenylamine, each having 4 to 18 carbon atoms, with an inorganic acid and/or an organic acid, such as hydrochloric acid and acetic acid.

(ii) Quaternary ammonium salts represented by the following general formulae (A), (B), and (C):

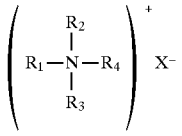

(A)

wherein $R_1$, $R_2$, $R_3$, and $R_4$, which may be identical or different, independently stand for an alkyl group or alkenyl group, each having 1 to 18 carbon atoms; and $X^-$ stands for a counter anion, including chlorine ion or bromine ion;

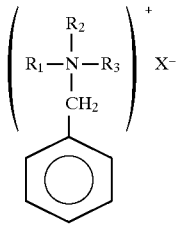

(B)

wherein $R_1$, $R_2$, $R_3$, and $X^-$ are as defined above; and

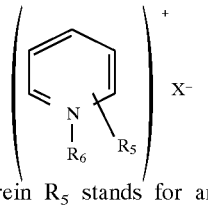

(C)

wherein $R_5$ stands for an alkyl group or alkenyl group having 8 to 18 carbon atoms; $R_6$ stands for a hydrogen atom or a methyl group; and $X^-$ is as defined above.

(iii) Alkylbetaines or alkenylbetaines represented by the following general formula:

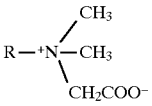

wherein R stands for an alkyl group or alkenyl group, each having 8 to 18 carbon atoms.

(iv) Alkylamine oxides or alkenylamine oxides represented by the following general formula:

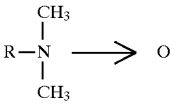

wherein R is as defined above.

(v) Alkylalanines or alkenylalanines represented by the following general formula:

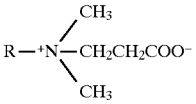

wherein R is as defined above.

(vi) Alkylene oxide adduct polymers of diamine or triamine represented by the following general formula (D) or (E):

$$RNHC_3H_6NHY \quad (D)$$

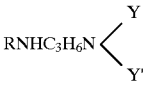

(E)

wherein R is as defined above; and Y and Y', which may be identical or different, independently stand for an oxyethylene moiety represented by the general formula:

$$\text{-}(C_2H_4O)_m\text{-}H$$

wherein m stands for a number of from 1 to 50.

(vii) Polyamine salts represented by the following formula (F) or (G):

$$RNHC_3H_6NHX' \quad (F)$$

$$RNH(C_3H_6NH)_2X' \quad (G)$$

wherein R is as defined above; and X' stands for an inorganic acid or organic acid, such as hydrochloric acid and acetic acid.

In the present invention, the amount of the nonionic surfactant having HLB values (hydrophilic-lipophilic balance) ranging from 13 to 19 is from 0.1 to 0.6 parts by weight, preferably 0.1 to 0.5 parts by weight, more preferably from 0.2 to 0.4 parts by weight, based on 100 parts by weight of the superheavy oil. When the amount of the nonionic surfactant exceeds 0.6 parts by weight, the particle size of oil droplets shifts to a smaller size, thereby making it impossible to obtain an emulsion of the present invention with a desired particle size distribution. On the other hand, when the amount is less than 0.1, the oil droplets become too large, thereby making the stability of the resulting emulsion poor. When the oil droplets having particle sizes of 150 $\mu$m or more are present in large amounts, the emulsion fuel can hardly be subjected to a complete combustion, a part of which remains incombusted. Therefore, the amount of the coarse particles of 150 $\mu$m or more should be preferably as little as possible.

In the emulsion fuel of the present invention, the nonionic surfactants are used as a main component for the surfactant component, and the anionic surfactants and the cationic surfactants may be blended thereto in amounts so as not to impair the inherent properties owned by the nonionic surfactants as mentioned above. By adding the anionic surfactants and the cationic surfactants, the particles are charged so as to increase the repulsive forces between the emulsion droplets, thereby making the resulting emulsion stable. In the case where the nonionic surfactants are used in combination with the anionic surfactants or with the cationic surfactants, the total amount of the surfactants is preferably from 0.1 to 0.6 parts by weight, more preferably 0.1 to 0.5 parts by weight, based on 100 parts by weight of the superheavy oil, as the case where only the nonionic surfactants are used. The amount of the anionic surfactants or the cationic surfactants is preferably 100 parts by weight or less, more preferably from 5 to 30 parts by weight, based on 100 parts by weight of the nonionic surfactant. The amount of water in the present invention is preferably from 22 to 31 parts by weight, more preferably 22 to 28 parts by weight, based on 100 parts by weight of the superheavy oil.

When polymeric compounds, such as naturally occurring polymers and synthetic polymers, and water-swellable clay minerals, each of which being exemplified below, are further used to a system using the nonionic surfactants mentioned above as the surfactant component, since the viscosity at the interface of the liquid droplets is increased, stable emulsified droplets are formed, thereby stabilizing the resulting emulsion. The polymeric compounds usable in the present invention include naturally occurring hydrophilic polymers, such as hydrophilic polymers derived from naturally occurring substances, and synthetic polymers. These may be used in an amount so as not to exceed the amount of the nonionic surfactant in step (a).

The hydrophilic polymers derived from naturally occurring substances including microorganisms are one or more substances selected from the group consisting of (A) hydrophilic polymers derived from microorganism, (B) hydrophilic polymers derived from plants, (C) hydrophilic polymers derived from animals, and (D) naturally occurring polymer derivatives given below. The hydrophilic polymeric substances dissolve or disperse in water, showing high viscosity and gelation.

(A) Hydrophilic Polymers Derived from Microorganism (Polysaccharides)

(a) Xanthan gum (b) Pullulan (c) Dextran (B) Hydrophilic Polymers Derived from Plants (Polysaccharides)

(a) Derived from marine algae:

(i) Agar (ii) Carrageenan (iii)Furcellaran (iv) Alginic acid and salts (Na, K, $NH_4$, Ca, or Mg) thereof (b) Derived from seeds:

(i) Locust bean gum (ii) Guar gum (iii)Tara gum (iv) Tamarind gum (c) Trees (exudates):

(i) Gum arabic (ii) Gum karaya (iii)Gum tragacanth (d) Derived from fruits:

(i) Pectin (C) Hydrophilic Polymers Derived from Animals (Proteins)

(i) Gelatin (ii) Casein (D) Naturally Occurring Polymer Derivatives (i) Cellulose derivatives, such as carboxymethylcellulose (ii) Chemically modified starch The synthetic polymers include the following water-soluble synthetic polymers given below.

(a) Homopolymers or copolymers of acrylic acid or derivatives thereof represented by the following general formula:

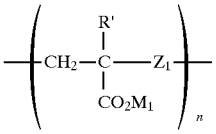

wherein R' stands for a hydrogen atom, a methyl group, or an ethyl group; $M_1$ stands for a hydrogen atom, a sodium ion, a potassium ion, a lithium ion, or an ammonium ion; $Z_1$ stands for a divalent group obtainable by copolymerizing a monomer represented by the following general formula:

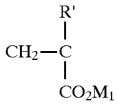

wherein R' and $M_1$ are as defined above, and a monomer copolymerizable therewith or salts thereof, wherein the salts of the copolymerizable monomers are exemplified by ammonium salts, sodium salts, potassium salts, and lithium salts; and n stands for a number of from 50 to 100,000. Examples of monomers copolymerizable with the monomer having the above formula include maleic acid (anhydride), itaconic acid (anhydride), α-olefins, acrylamide, vinylsulfonic acid, allylsulfonic acid, methallylsulfonic acid, and acrylamidomethylpropylsulfonic acid, and salts thereof, including ammonium salts, sodium salts, potassium salts, and lithium salts; dialkyl aminoethyl methacrylates, such as dimethyl aminoethyl methacrylate and diethyl aminoethyl methacrylate and salts thereof, quaternary compounds thereof, including hydrochloric acid, diethyl sulfate, and dimethyl sulfate.

(b) Homopolymers or copolymers of acrylamide or derivatives thereof represented by the following general formula:

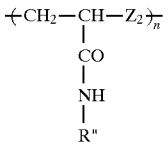

wherein R" stands for a hydrogen atom or a $C_2H_4OH$ group; $Z_2$ stands for a divalent group obtainable by copolymerizing a monomer represented by the following general formula:

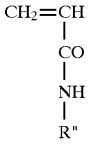

wherein R" is as defined above, and a monomer copolymerizable therewith, and salts thereof, wherein the salts of the copolymerizable monomers are exemplified by ammonium salts, sodium salts, potassium salts, and lithium salts; and n stands for a number of from 50 to 100,000. Examples of the monomers copolymerizable with the monomer having the above formula include vinylsulfonic acid, allylsulfonic acid, methallylsulfonic acid, acrylamidomethylpropylsulfonic acid, and salts thereof, including ammonium salts, sodium salts, potassium salts, and lithium salts; dialkyl aminoethyl methacrylates, such as dimethyl aminoethyl methacrylate and dimethyl aminoethyl methacrylate and salts thereof, quaternary compounds thereof, including hydrochloric acid, diethyl sulfate, and dimethyl sulfate; styrene; α-olefins having 2 to 18 carbon atoms; and vinylallyl alcohols.

(c) Homopolymers of maleic anhydride or itaconic anhydride, or copolymers thereof represented by the following general formula:

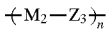

wherein $M_2$ stands for a maleic anhydride unit or itaconic anhydride unit; $Z_3$ stands for an α-olefin unit, the α-olefins including ethylene, propylene, butylene, isobutylene, octene, decene, and dodecene, or a styrene unit; and n stands for a number of from 50 to 100,000.

(d) Polyvinyl alcohols or copolymers thereof represented by the following general formula:

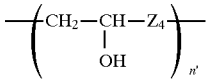

wherein $Z_4$ stands for a vinyl acetate unit or styrene unit; and n' stands for a number of from 30 to 100,000.

(e) Homopolymers of vinylpyrrolidone, or copolymers thereof represented by the following general formula:

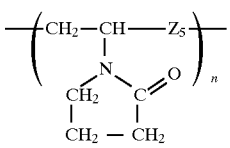

wherein $Z_5$ stands for a divalent group obtainable by copolymerizing a vinylpyrrolidone monomer or salts thereof, wherein the salts of the vinylpyrrolidone include ammonium salts, sodium salts, potassium salts, and lithium salts, and a monomer copolymerizable therewith, and salts thereof, wherein the salts of the copolymerizable monomers include ammonium salts, sodium salts, potassium salts, and lithium salts. Examples of the monomers copolymerizable with the vinylpyrrolidone monomer or salts thereof include acrylamide, vinylsulfonic acid, methallylsulfonic acid, maleic anhydride, itaconic anhydride, and salts thereof, such as ammonium salts, sodium salts, potassium salts, and lithium salts; styrene; a-olefins having 2 to 18 carbon atoms; and n stands for a number of from 50 to 100,000.

(f) Polyalkylene oxides having a molecular weight of from 10,000 to 5,000,000, wherein the ethylene oxide content is 95% or more, which may include those containing in the molecule 5% or less of various block polymers of propylene oxide, butylene oxide, and styrene oxide or alkylaryl groups or alkyl groups.

The water-swellable clay minerals usable in the present invention include the following ones.

The clay minerals usable in the present invention is a highly swellable fine clay mineral, wherein the term "highly swellable" clay minerals refer to those bound with a large amount of water molecules when the clay minerals are suspended in water, so as to have a relaxation time ($T_2$) for water molecules of from 900 msec or less, preferably 500 msec or less, the relaxation time for water molecules being measured by a nuclear magnetic resonance spectrometer when the clay minerals are suspended in water in an amount of 1% by weight on a dry basis. When the relaxation time for the water molecules exceeds 900 msec, the binding force of the clay minerals to the water molecules becomes notably weak, to such an extent that the effects of the present invention cannot be sufficiently obtained. In addition, the term "fine clay mineral" refers to the clay minerals having an average particle size of from 100 $\mu$m or less. When the clay mineral has an average particle size exceeding 100 $\mu$m, the binding force of the clay minerals to the water molecules becomes notably weak, and at the same time sedimentation of the clay minerals is liable to occur, thereby making it impossible to sufficiently attain the effects of the present invention.

Specifically, the fine clay minerals having a high swellability and a high binding force to the water molecules, including smectites, vermiculites, and chlorites, fall within the scope of the present invention. Among them, however, those having a $T_2$ value exceeding 900 msec are outside the scope of the present invention. Further, since kaolin produced in Georgia, U.S.A., general kaolin and talc have weak binding forces to the water molecules, they are excluded from the scope of the present invention.

The highly swellable fine clay minerals, such as smectites, vermiculites, and chlorites, usable in the present invention will be explained in detail below.

(A) Smectite has a complicated chemical composition comprising two tetrahedral sheets and one octahedral sheet inserted therebetween (namely a 2:1 layer), because substitution takes place in a wide range and various ions accompanied by water molecules are intercalated. The smectite is represented by, for example, the following general formula:

$$X_m(Y^{2+},Y^{3+})_{2\text{-}3}Z_4O_{10}(OH)_2.nH_2O,$$

wherein X stands for K, Na, ½Ca, or ½Mg; $Y^{2+}$stands for $Mg^{2+}$, $Fe^{2+}$, $Mn^{2+}$, $Ni^{2+}$, or $Zn^{2+}$, $Y^{3+}$stands for $Al^{3+}$, $Fe^{3+}$, $Mn^{3+}$, or $Cr^{3+}$; and Z stands for Si and/or Al, with proviso that X, Y, and Z stand for an intercalated cation, an octahedral cation, and a tetrahedral cation, respectively.

Typical examples of the smectites are the following ones:

Dioctahedral (octahedral cations being mainly trivalent):

Montmorillonites represented by, for example, the following formula:

$$X_{0.33}(Al_{1.67}Mg_{0.33})Si_4O_{10}(OH)_2.nH_2O;$$

Beidellites represented by, for example, the following formula:

$$X_{0.33}(Al_2)(Al_{0.33}Si_{3.67})O_{10}(OH)_2.nH_2O; \text{ and}$$

Nontronites represented by, for example, the following formula:

$$X_{0.33}(Fe(III)_2)(Al_{0.33}Si_{3.67})O_{10}(OH)_2.nH_2O.$$

Trioctahedral (octahedral cations being mainly divalent):

Saponites represented by, for example, the following formula:

$$X_{0.33}(Mg_3)(Al_{0.33}Si_{3.67})O_{10}(OH)_2.nH_2O;$$

Iron saponites represented by, for example, the following formula:

$$X_{0.33}(Mg,Fe(II))_3(Al_{0.33}Si_{3.67})O_{10}(OH)_2.nH_2O;$$

Hectorites represented by, for example, the following formula:

$$X_{0.33}(Mg_{2.67}Li_{0.33})Si_4O_{10}(OH)_2.nH_2O;$$

Sauconites represented by, for example, the following formula:

$$X_{0.33}(Mg,Zn)_3(Si_{3.67}Al_{0.33})O_{10}(OH)_2.nH_2O; \text{ and}$$

Stevensites represented by, for example, the following formula:

$$X_{0.33/2}(Mg_{2.97})Si_4O_{10}(OH)_2.nH_2O.$$

Among the smectites listed above, the montmorillonites, the beidellites, and the nontronites constitute a series which can be subjected to isomorphous substitution. The stevensites have layer charges of one-half of that of the other smectites, and thus having an intermediary property of the dioctahedral smectites and the trioctahedral smectites.

(B) Vermiculites pertain to 2:1 layer silicates and are represented by, for example, the following formula:

$$(Mg,Fe(III),Al)_{2\text{-}3}(Si_{4\text{-}x}Al_x)O_{10}(OH)_2(M^+,M^{2+}{}_{1/2})_x.nH_2O.$$

In the above formula, M stands for an intercalated exchangeable cation, and when the vermiculite is in the form of coarse particles, M is mainly composed of Mg. "n" in the above formula stands for the amount of water, and when the intercalated cation is Mg, water forms a bimolecular layer over a wide temperature range and n is in the range of from about 3.5 to 5. "x" in the above formula stands for layer charges which are in the range of from 0.6 to 0.9.

In the above formula, it is assumed that all of the layer charges are generated by the substitution of tetrahedral cations. However, in certain cases, the octahedral sheet may actually carry a negative charge to which the layer charges are ascribed. The number of octahedral cations is 2 to 3, and the vermiculites are classified into dioctahedral vermiculites and trioctahedral vermiculites. The vermiculites in the form of coarse particles obtainable by the weathering of biotite and phlogopite are trioctahedral vermiculites.

(C) The structures of the chlorites are similar to those of the smectites and the vermiculites, and the base plane interval is 14 to 15 Å. The chlorites are typically a 2:1 hydrated silicate which can be classified into trioctahedral chlorites and dioctahedral chlorites depending on the properties of the 2:1 layer.

The trioctahedral chlorites are represented by, for example, the following formula:

$$(R_{6-x}^{2+}R_x^{3+})(Si_{4-x}Al_x)O_{10}(OH)_8.$$

In the above formula, $R^{2+}$ is mainly composed of Mg and $Fe^{2+}$, which may also include $Mn^{2+}$ and $Ni^{2+}$; and $R^{3+}$ is mainly composed of Al, which may also include $Fe^{3+}$ and $Cr^{3+}$. "x" in the above formula is a value of from 0.8 to 1.6.

A chlorite wherein $R^{2+}$ is mainly composed of Mg is so-called "clinochlore" [e.g. $(Mg_5Al)(Si_3Al)O_{10}(OH)_8$]; and a chlorite wherein $R^{2+}$ is mainly composed of Fe(II) is so-called "chamosite" [e.g. $(Fe_5Al)(Si_3Al)O_{10}(OH)_8$]. Examples of other trioctahedral chlorites include "pennantite" wherein $R^{2+}$ is mainly composed of Mn(II); and "unimite" wherein $R^{2+}$ is mainly composed of Ni(II).

The dioctahedral chlorites wherein the octahedral cation is mainly composed of Al are classified into the following three kinds.

Sudoite [e.g. $(Mg,Al)_{4.6-5}(Si,Al)_4O_{10}(OH)_8$;

Cookeite [e.g. $(LiAl_4)(Si_3Al)O_{10}(OH)_8$; and

Donbassite [e.g. $Al_{4-4.2}R_{0.2}(Si,Al)_4O_{10}(OH)_8$.

The clay minerals comprising montmorillonite, the clay mineral pertaining to smectite, as the main component, and further containing as impurities, quartz, α-cristobalite, opal, feldspar, mica, zeolite, calcite, dolomite, gypsum, and iron oxide are so-called "bentonite." The bentonites include sodium bentonite rich in Na ions and calcium bentonite rich in Ca ions. Since sodium bentonite has high swellability, it falls within the scope of the clay minerals of the present invention, while calcium bentonite has notably low swellability that it is excluded from the scope of the present invention.

Among the sodium bentonites, those having a higher content of the montmorillonites are preferred. Also, the particle size is preferably 100 μm or less, more preferably 10 μm or less. The sodium bentonites falling within the scope of the clay minerals of the present invention should have a relaxation time ($T_2$) for water molecules of from 900 msec or less, preferably 500 msec or less, the relaxation time for water molecules being measured by a nuclear magnetic resonance spectrometer when the clay minerals are suspended in water in an amount of 1% by weight on a dry basis.

In the sodium bentonites, impurities contained therein and differences in swellability depend upon the place of origin. When the montmorillonite content in the sodium bentonites is increased by elutriation or other means, the $T_2$ value of the aqueous suspension of the resulting sodium bentonite becomes low, thereby more fully enhancing the effects of the present invention.

The above polymeric compounds and the clay minerals may be used alone or in combination of two or more. The polymeric compounds and clay minerals may be preferably added so as not to exceed the amount of the nonionic surfactant used. Specifically, the amount of the polymeric compounds or clay minerals is preferably from 2 to 40 parts by weight, more preferably from 4 to 20 parts by weight, based on 100 parts by weight of the nonionic surfactant. The polymeric compounds or clay minerals may be added while preparing a homogeneous liquid mixture formed by emulsifying superheavy oil in water using a nonionic surfactant, or they may alternatively added after preparing the homogeneous liquid mixture. When the polymeric compounds or clay minerals are added to a surfactant component comprising a nonionic surfactant and an anionic surfactant or a cationic surfactant, the effects for adding the polymeric compounds or the clay minerals are notably exhibited. In this case, the polymeric compounds and the clay minerals may be used in combination.

When the liquid mixture is prepared by emulsifying a superheavy oil with a nonionic surfactant, oxides of magnesium, calcium, or iron, hydroxides of magnesium, calcium, or iron, salts, such as nitrates and acetates, of magnesium, calcium, or iron may be added. By adding oxides, hydroxides, or salts, the emulsification stability effect can be obtained. In the case where the oxides or hydroxides are added, the amount thereof is from 0.01 to 0.5 parts by weight, preferably from 0.02 to 0.08 parts by weight, based on 100 parts by weight of the superheavy oil.

The method for producing the superheavy oil emulsion fuel of the present invention comprises the steps of:

(a) adding to a superheavy oil 0.1 to 0.6 parts by weight of a nonionic surfactant having an HLB (hydrophilic-lipophilic balance) of 13 to 19, based on 100 parts by weight of the superheavy oil, and water, to prepare a homogeneous liquid mixture; and (b) mechanically mixing the homogeneous liquid mixture with a high shearing stress.

In the case where the emulsion has a high viscosity, a step (c) of diluting the resulting mixture obtained in step (b) with water or water containing additives, such as surfactants having an HLB of 13 to 19 may be further provided subsequent to step (b), to prepare an emulsion fuel having a high fluidity. Especially, the viscosity ($100\ s^{-1}$, 25° C.) of the resulting mixture may be adjusted to 3000 cp or less. In the resulting emulsion fuel of the present invention, the concentration of the superheavy oil in the emulsion fuel is from 76.5 to 82.0% by weight, preferably from 78.0 to 81.0% by weight, more preferably 78.0 to 81.0% by weight, and the emulsion has a suitable particle size distribution in a given range.

The emulsion fuel obtainable by the method of the present invention has a particle size distribution wherein a 10%-cumulative particle size is from 1.5 to 8 μm, a 50%-cumulative particle size is from 11 to 30 μm, preferably 15 to 20 μm, and a 90%-cumulative particle size is from 25 to 150 μm, and wherein coarse particles having particle sizes of 150 μm or more occupy 3% by weight or less in the entire emulsion fuel. Incidentally, the term "particle size" used herein refers to particle diameter. The "particle size" and "amount of coarse particles" are evaluated by methods explained in Examples which are set forth hereinbelow.

Figure 2:
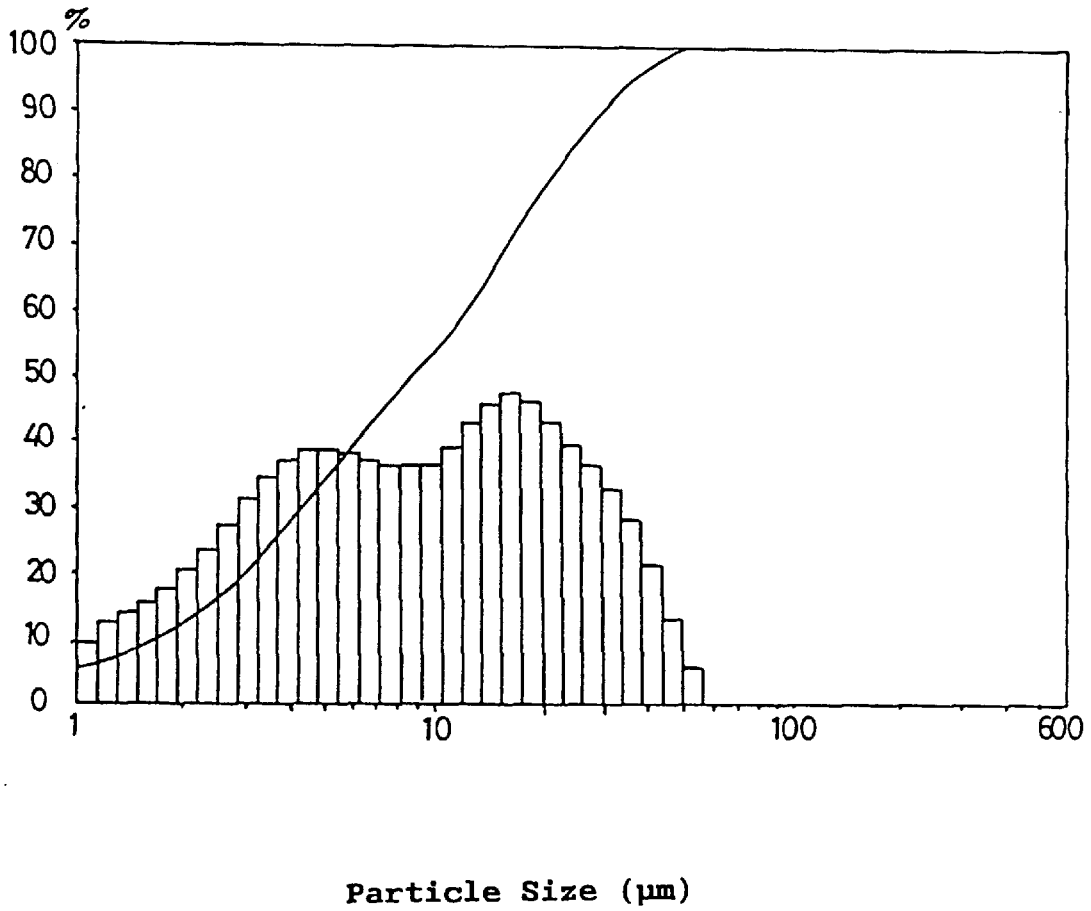
FIG. 2 is a graph showing a particle size distribution of an emulsion fuel obtained in Comparative Example 1.

FIG. 1 is a graph showing a particle size distribution of an emulsion fuel obtained in Example 1 set forth below; and FIG. 2 is a graph showing a particle size distribution of an emulsion fuel obtained in Comparative Example 1. The emulsion fuels shown in FIGS. 1 and 2 are produced under the same conditions except for changing the amounts of the nonionic surfactant. The particle size distribution of the inventive product shown in FIG. 1 is such that a 10%-cumulative particle size is 3.1 μm, a 50%-cumulative particle size is 17.4 μm, and a 90%-cumulative particle size is 58.1 μm, and wherein coarse particles having particle sizes of 150 μm or more occupy 1.0% by weight in the entire emulsion fuel. On the other hand, the particle size distribution of the comparative product shown in FIG. 2 is such that a 10%-cumulative particle size is 1.7 μm, a 50%-cumulative particle size is 8.6 μm, and a 90%-cumulative particle size is 30.0 μm, and wherein coarse particles having particle sizes of 150 μm or more occupy 0% in the entire emulsion.

The method of the present invention is characterized in that the superheavy oil emulsion fuel is produced by limiting the amount of the surfactants having the nonionic surfactants mentioned above as a main component to 0.1 to 0.6 parts by weight, preferably 0.1 to 0.5 parts by weight, based on 100 parts by weight of the superheavy oil, and that a high shearing stress is applied upon mechanical mixing, to produce an emulsion fuel having the particle size distribution specified as above and having a concentration of the superheavy oil of from 76.5 to 82.0% by weight, preferably from 78.0 to 81.0% by weight. The resulting emulsion fuel has a high superheavy oil concentration, good fluidity, with easy handling and conveying.

The agitators to be used for pre-mixing in the present invention are not particularly required to have a high shearing stress, and any one of general agitators, such as propeller agitators, will suffice. The agitation after the pre-mixing is preferably carried out by high shearing stress agitators. Examples thereof include line mixers, arrow blade turbine blade mixers, propeller blade mixers, full margin-type blade mixers, paddle blade mixers, high-shearing turbine mixers, homogenizers, and colloidal mills. Here, the term "high shearing stress" refers to a shearing stress of 1,000 to 20,000 $sec^{-1}$, more preferably 4,000 to 20,000 $sec^{-1}$.

When the concentration of the superheavy oil exceeds 80% by weight, the viscosity of the emulsion composition becomes too high. Therefore, after the mechanical mixing by shearing force as mentioned above, when the emulsion having too high superheavy oil concentration is further diluted with water or an aqueous solution containing a surfactant having HLB of 13 to 19, and then agitated so as to give an emulsion fuel with a superheavy oil concentration of from 77 to 79% by weight, the viscosity is also lowered to 3000 c.p. or less, preferably 2000 c.p. or less, particularly from 300 to 1000 c.p. (100 $sec^{-1}$, 25° C.), thereby producing stable emulsion.

The present invention will be further described by means of the following working examples and comparative examples, without intending to restrict the scope of the present invention thereto.

EXAMPLES 1 to 15 AND COMPARATIVE EXAMPLES 1 TO 4

Given amounts of water and asphalt ("STRAIGHT ASPHALT," according to JIS K-2207, manufactured by Cosmo Oil Co.; penetration: 80 to 100), and a surfactant and/or a stabilizer shown in Tables 1 to 3 were placed in a 800 ml-stainless steel container, and the contents were heated to a given temperature in a thermostat, and the mixture in the container was pre-mixed using an agitator equipped with double, helical ribbon blades for 5 minutes at a rotational speed of 60 r.p.m. Thereafter, the resulting mixture was blended and emulsified using a "T.K. HOMO MIXER, Model M" (equipped with low-viscosity agitating blades; manufactured by Tokushu Kika Kogyo) to produce an emulsion fuel under the following conditions.

The production conditions are as follows. Agitation rotational speed: 8000 r.p.m.; agitation time: 2 minutes; temperature: 80° C.; shearing stress: 12000/sec. Here, the specific gravity of water is 0.997 (25° C.), and the specific gravity of oil is 1.026 (25° C.). The viscosity was measured by using a double, cylindrical rotational viscometer "RV-2" (equipped with a sensor "MV-1," manufactured by Haake Co.) at 25° C. while applying a shearing stress of 100/sec.

The particle size of the obtained emulsion fuel was evaluated by using a granulometer "HR850-B" (manufactured by Cyrus Co.) to determine 10%-cumulative particle size (average particle diameter), 50%-cumulative particle size (average particle diameter), and 90%-cumulative particle size (average particle diameter).

Specifically, the particle size was evaluated by the following method. Several droplets of the emulsion fuel were added in an aqueous solution containing 0.3% by weight of a nonionic surfactant (polyoxyethylene(20 mol) nonyl phenyl ether), and the resulting mixture was agitated using a stirrer to provide a homogeneous liquid mixture. The homogeneous liquid mixture obtained above was placed in a granulometer to evaluate granularity. The measurement mode was set at 1 to 600 μm.

The amount of coarse particles was evaluated by measuring the components having particle sizes of 150 μm or more using a wet sieve. Specifically, 20 g of each the emulsion fuels was weighed and then poured on the sieve. After rinsing the mesh-on particles with water, they were dried with a vacuum dryer. The amount of the particles remaining on the sieve after drying was measured to calculate the amount of coarse particles. Also, emulsion stabilities after one day, after one week, and after one month were evaluated by the amount of sediments. Further, the overall evaluation was conducted by collectively evaluating the viscosity of the emulsion fuels, the particle sizes at 10% accumulation, 50% accumulation, and 90% accumulation, the percentage of coarse particles, and the emulsion stability, as determined by the following standards:

◎: Very excellent;

○: Good;

Δ: Slight effect; and x: No effects.

TABLE 1

| Example Nos. | Surfactant and Stabilizer | HLB | Viscosity (c.p.) | Conc. of Superheavy Oil (wt %) | Particle Size (μm) 10% Cum. | 50% Cum. | 90% Cum. | Coarse Particles (wt %) | Emulsion Stability After One Day | After One Week | After One Mon. | Overall Evaluation |
|---|---|---|---|---|---|---|---|---|---|---|---|---|
| 1 | Polyoxyethylene nonyl phenyl ether 0.30 wt % | 14.4 | >3000 | 81.1 | 3.1 | 17.4 | 58.1 | 1.0 | Creamy | Creamy | Creamy | ○ |

TABLE 1-continued

| Example Nos. | Surfactant and Stabilizer | | HLB | Viscosity (c.p.) | Conc. of Super-heavy Oil (wt %) | Particle Size (μm) 10% Cum. | 50% Cum. | 90% Cum. | Coarse Particles (wt %) | Emulsion Stability After One Day | After One Week | After One Mon. | Overall Evaluation |
|---|---|---|---|---|---|---|---|---|---|---|---|---|---|
| 2 | Polyoxyethylene nonyl phenyl ether | 0.30 wt % | 14.4 | 2193 | 79.6 | 2.8 | 14.4 | 55.0 | 1.6 | Excel. Emulsi-fication | Slightly Soft Sediment | Soft Sediment | ◎ |
| 3 | Polyoxyethylene nonyl phenyl ether | 0.30 wt % | 14.4 | 187 | 77.6 | 2.0 | 13.4 | 42.1 | 1.8 | Excel. Emulsi-fication | Slightly Soft Sediment | Soft Sediment | ◎ |
| 4 | Polyoxyethylene nonyl phenyl ether | 0.30 wt % | 14.4 | 169 | 77.1 | 1.6 | 12.8 | 30.0 | 2.2 | Excel. Emulsi-fication | Soft Sediment | Soft Sediment | ○ |
| 5 | Polyoxyethylene nonyl phenyl ether | 0.30 wt % | 14.4 | 148 | 76.5 | 1.5 | 12.2 | 25.0 | 2.9 | Excel. Emulsi-fication | Soft Sediment | Soft Sediment | ○ |
| 6 | Polyoxyethylene nonyl phenyl ether | 0.30 wt % | 16.0 | 2350 | 79.7 | 2.5 | 13.5 | 49.0 | 1.7 | Excel. Emulsi-fication | Slightly Soft Sediment | Soft Sediment | ◎ |
| 7 | Polyoxyethylene nonyl phenyl ether | 0.30 wt % | 17.1 | 2911 | 79.8 | 1.5 | 12.9 | 40.1 | 2.0 | Excel. Emulsi-fication | Slightly Soft Sediment | Soft Sediment | ◎ |
| 8 | Polyoxyethylene nonyl phenyl ether | 0.30 wt % | 13.3 | 2615 | 79.7 | 1.7 | 14.0 | 47.0 | 1.8 | Excel. Emulsi-fication | Slightly Soft Sediment | Soft Sediment | ◎ |

TABLE 2

| Example Nos. | Surfactant and Stabilizer | | HLB | Viscosity (c.p.) | Conc. of Super-heavy Oil (wt %) | Particle Size (μm) 10% Cum. | 50% Cum. | 90% Cum. | Coarse Particles (wt %) | Emulsion Stability After One Day | After One Week | After One Mon. | Overall Evaluation |
|---|---|---|---|---|---|---|---|---|---|---|---|---|---|
| 9 | Polyoxyethylene oleyl ether | 0.30 wt % | 14.4 | 2438 | 79.8 | 2.1 | 14.4 | 41.2 | 1.9 | Excel. Emulsi-fication | Slightly Soft Sediment | Soft Sediment | ◎ |
| 10 | Polyoxyethylene nonyl phenyl ether | 0.24 wt % | 14.4 | 1524 | 79.5 | 3.0 | 16.5 | 53.4 | 1.9 | Excel. Emulsi-fication | Slightly Soft Sediment | Soft Sediment | ◎ |
| | Sodium lignin sulfonate | 0.06 wt % | | | | | | | | | | | |
| 11 | Polyoxyethylene nonyl phenyl ether | 0.24 wt % | 14.4 | 1852 | 78.4 | 2.6 | 15.2 | 56.1 | 1.4 | Excel. Emulsi-fication | Excel. Emulsi-fication | Slightly Soft Sediment | ◎ |
| | Sodium lignin sulfonate | 0.05 wt % | | | | | | | | | | | |
| | Xanthan gum | 0.01 wt % | | | | | | | | | | | |
| 12 | Polyoxyethylene nonyl phenyl ether | 0.24 wt % | 14.4 | 1913 | 78.2 | 2.4 | 14.9 | 55.6 | 1.4 | Excel. Emulsi-fication | Excel. Emulsi-fication | Slightly Soft Sediment | ◎ |
| | Sodium lignin sulfonate | 0.03 wt % | | | | | | | | | | | |
| | Hydroxyethyl cellulose | 0.03 wt % | | | | | | | | | | | |
| 13 | Polyoxyethylene nonyl phenyl ether | 0.24 wt % | 14.4 | 1996 | 78.0 | 2.4 | 14.5 | 55.2 | 1.5 | Excel. Emulsi-fication | Excel. Emulsi-fication | Slightly Soft Sediment | ◎ |
| | Sodium lignin sulfonate | 0.03 wt % | | | | | | | | | | | |
| | Water-swellable Montmorillonite | 0.03 wt % | | | | | | | | | | | |

TABLE 3

| Nos. | Surfactant and Stabilizer | | HLB | Viscosity (c.p.) | Conc. of Super-heavy Oil (wt %) | Particle Size (μm) 10% Cum. | 50% Cum. | 90% Cum. | Coarse Particles (wt %) | Emulsion Stability After One Day | After One Week | After One Mon. | Overall Evalu-ation |
|---|---|---|---|---|---|---|---|---|---|---|---|---|---|
| Example Nos. | | | | | | | | | | | | | |
| 14*1 | Polyoxyethylene nonyl phenyl ether | 0.30 wt % | 14.4 | 180 | 77.5 | 3.0 | 17.0 | 57.5 | 0.3 | Excel. Emulsi-fication | Excel. Emulsi-fication | Slightly Soft Sediment | ⊙ |
| 15*2 | Polyoxyethylene nonyl phenyl ether | 0.30 wt % | 14.4 | 194 | 77.7 | 2.5 | 14.1 | 54.0 | 1.0 | Excel. Emulsi-fication | Excel. Emulsi-fication | Slightly Soft Sediment | ⊙ |
| Comparative Example Nos. | | | | | | | | | | | | | |
| 1 | Polyoxyethylene nonyl phenyl ether | 0.60 wt % | 14.4 | —*1 | 81.1 | 1.7 | 8.6 | 30.0 | 0 | No Free Flowing | No Free Flowing | No Free Flowing | X |
| 2 | Polyoxyethylene nonyl phenyl ether | 0.30 wt % | 14.4 | 122 | 75.4 | 1.4 | 6.8 | 23.4 | 3.5 | Slightly Soft Sediment | Soft Sediment | Soft Sediment | Δ |
| 3 | Polyoxyethylene nonyl phenyl ether | 0.30 wt % | 14.4 | 103 | 73.4 | 1.3 | 5.3 | 23.0 | 4.2 | Slightly Soft Sediment | Soft Sediment | Soft Sediment | Δ |
| 4 | Polyoxyethylene nonyl phenyl ether | 0.12 wt % | 14.4 | —*3 | 79.6 | —*3 | —*3 | —*3 | 52.3 | Tar Sediment | Separation | Separation | X |
| | Sodium lignin sulfonate | 0.18 wt % | | | | | | | | | | | |

Notes after Table 3:
*1: An emulsion fuel prepared by diluting the emulsion fuel obtained in Example 1 with an aqueous solution of 0.30% by weight-polyoxyethylene (13 mol) nonyl phenyl ether to a given concentration, and then blending the resulting mixture at a high shearing stress in the same manner as in Example 1.
*2: An emulsion fuel prepared by diluting the emulsion fuel obtained in Example 2 with an aqueous solution of 0.30% by weight-polyoxyethylene (13 mol) nonyl phenyl ether to a given concentration, and then blending the resulting mixture at a high shearing stress in the same manner as in Example 1.
*3: Non-detectable.

As is clear from Tables 1 to 3, the emulsion fuels obtained according to the method of the present invention had high superheavy oil concentrations and excellent emulsion stability. By contrast, the emulsion fuels obtained in Comparative Examples had low superheavy oil concentrations, or had poor emulsion stability even at high superheavy oil concentrations.

INDUSTRIAL APPLICABILITY

According to the method of the present invention, a stable, easy-to-handle superheavy oil emulsion fuel having high superheavy oil concentration and good fluidity can be easily produced.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for producing a superheavy oil emulsion fuel comprising the steps of:

(a) adding to a superheavy oil 0.1 to 0.6 parts by weight of a nonionic surfactant having an HLB (hydrophilic-lipophilic balance) of 13 to 19, based on 100 parts by weight of the superheavy oil, and water, to prepare a homogeneous liquid mixture, wherein optionally an anionic surfactant or a cationic surfactant is further added provided that the total amount of said nonionic surfactant and said anionic surfactant on the total amount of said nonionic surfactant and said cationic surfactant is from 0.1 to 0.6 parts by weight, based on 100 parts by weight of the superheavy oil, and that the amount of said anionic surfactant or said cationic surfactant is 100 parts by weight or less, based on 100 parts by weight of the nonionic surfactant; and (b) mechanically mixing the homogeneous liquid mixture with a high shearing stress, to produce a superheavy oil emulsion fuel having a particle size distribution wherein a 10%-cumulative particle size is from 1.5 to 8 μm, a 50%-cumulative particle size is from 11 to 30 μm, and a 90%-cumulative particle size is from 25 to 150 μm, and wherein coarse particles having particle sizes of 150 μm or more occupy 3% by weight or less in the entire emulsion fuel, and wherein the concentration of the superheavy oil is from 76.5 to 82.0% by weight.

2. The method according to claim 1, wherein a polymeric compound selected from the group consisting of naturally occurring polymers and synthetic polymers, or a water-swellable clay mineral is further added in an amount so as not to exceed the amount of the nonionic surfactant in step (a).

3. The method according to claim 1, or wherein one or more compounds selected from the group consisting of oxides of magnesium, calcium, and iron, hydroxides of magnesium, calcium, and iron, and salts of magnesium, calcium, and iron are further added in an amount of 0.01 to 0.5 parts by weight, based on 100 parts by weight of the superheavy oil in step (a).

4. The method according to any one of claims 1 to 3, wherein the mechanical mixing is carried out at a shearing stress of from 1,000 to 20,000 $s^{-1}$.

5. The method according to any one of claims 1 to 3, subsequent to step (b), further comprising the step of:

(c) diluting the resulting mixture obtained in step (b) with water or water containing a surfactant having an HLB of 13 to 19, to thereby adjust the viscosity (100 $s^{-1}$, 25° C.) of the resulting mixture to 3000 cp or less.

6. The method according to any one of claims 1 to 3, wherein the concentration of the superheavy oil is from 78.0 to 81.0% by weight.

7. The method according to any one of claims 1 to 3, wherein said nonionic surfactant is an alkylene oxide adduct of an alkylphenol.

8. The method according to claim 1, wherein said anionic surfactant is one or more compounds selected from the group consisting of lignin sulfonates, formalin condensates of lignin sulfonic acid and naphthalenesulfonic acid or salts thereof, and formalin condensates of naphthalenesulfonates.

* * * * *